US011583124B2

(12) United States Patent
Scappaticci

(10) Patent No.: US 11,583,124 B2
(45) Date of Patent: Feb. 21, 2023

(54) SECURED DELIVERY BOX

(71) Applicants: KS2 Corp Inc., Montreal (CA); inField Clipboard Inc., Markham (CA)

(72) Inventor: Anthony Scappaticci, Montreal (CA)

(73) Assignees: KS2 CORP INC., Montreal (CA); INFIELD CLIPBOARD INC., Markham (CA)

( * ) Notice: Subject to any disclaimer, the term of this patent is extended or adjusted under 35 U.S.C. 154(b) by 0 days.

(21) Appl. No.: 17/471,624

(22) Filed: Sep. 10, 2021

(65) Prior Publication Data

US 2022/0079367 A1 Mar. 17, 2022

Related U.S. Application Data

(60) Provisional application No. 63/077,235, filed on Sep. 11, 2020.

(51) Int. Cl.
*G07C 9/00* (2020.01)
*A47G 29/14* (2006.01)

(52) U.S. Cl.
CPC ..... *A47G 29/141* (2013.01); *G07C 9/00817* (2013.01); *G07C 9/00896* (2013.01); *A47G 2029/147* (2013.01); *A47G 2029/149* (2013.01); *G07C 2009/0092* (2013.01); *G07C 2009/00833* (2013.01)

(58) Field of Classification Search
None
See application file for complete search history.

(56) References Cited

U.S. PATENT DOCUMENTS 6,882,269 B2 * 4/2005 Moreno ..... A47G 29/141 340/568.1
10,449,889 B2 * 10/2019 Letson ..... B60P 3/20
11,103,063 B2 * 8/2021 Finney ..... A47B 81/005

* cited by examiner

*Primary Examiner* — K. Wong
(74) *Attorney, Agent, or Firm* — Benoit & Cote Inc.; France Cote

(57) ABSTRACT

The present invention discloses a system particularly adapted for refrigerated or heated goods that can keep the goods at a desired temperature until the goods are picked up by the patrons. More precisely, there is disclosed a secured delivery box for storing and providing access to goods therefrom, comprising: a structure defining storage areas to store the goods; doors, wherein each door is controllably movable between a closed position and an open position respectively preventing and providing access to a respective one of the storage areas; locking mechanisms, wherein each locking mechanism is associated to a respective one of the doors, and wherein the locking mechanisms when in a lock state lock the respective door in a closed position preventing access to the respective one of the storage areas; and a processor connected to Internet and to the locking mechanisms, wherein the processor is adapted to signal the locking mechanisms to exit the locked state.

4 Claims, 2 Drawing Sheets

SECURED DELIVERY BOX

CROSS-REFERENCE TO RELATED APPLICATION

This application claims priority under Section 119(e) from U.S. Provisional Application Ser. No. 63/077,235, filed Sep. 11, 2020, entitled "SECURED DELIVERY BOX" the contents of which is incorporated herein by reference.

BACKGROUND

(a) Field

The subject matter disclosed generally relates to delivery services and in particular to a system and method that allows deliveries to be made at any time without the need for business personnel at the delivery site.

(b) Related Prior Art

Increasingly, commerce involves delivering goods in packages to individual households from online purchases. This has led to the problem of packages being left for homeowners on the homeowner's property and stolen before the homeowner can pick them up—for example, if the homeowner is at work at the time of delivery.

Further, in case of packages requiring controlled conditions such as a refrigerated environment, no known solution provides the required solution to properly store the goods between the delivery time and the pickup time.

SUMMARY

According to an embodiment, there is provided a system particularly adapted for refrigerated goods that can keep the goods at a desired temperature until the goods are picked up by the patrons.

According to an embodiment, there is provided a system particularly adapted for heated goods that can keep the goods at a desired temperature until the goods are picked up by the patrons.

According to an embodiment, there is provided a secured delivery box for storing and providing access to goods therefrom, comprising:

a structure defining storage areas to store the goods;

doors, wherein each door is controllably movable between a closed position and an open position respectively preventing and providing access to a respective one of the storage areas;

locking mechanisms, wherein each locking mechanism is associated to a respective one of the doors, and wherein the locking mechanisms when in a lock state lock the respective door in a closed position preventing access to the respective one of the storage areas; and a processor connected to Internet and to the locking mechanisms, wherein the processor is adapted to signal the locking mechanisms to exit the locked state.

According to an embodiment, the secured delivery box further comprises a temperature control system for maintaining temperature of one of the storage areas within a temperature range, wherein the processor is adapted to unlock the door of the temperature-controlled storage area upon reception over the Internet of a signal indicative of the goods to be stored should be stored at a temperature within the temperature range.

According to an embodiment, the secured delivery box further comprises a keypad, wherein the keypad provides an interface to enter a code to unlock the locking mechanisms.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
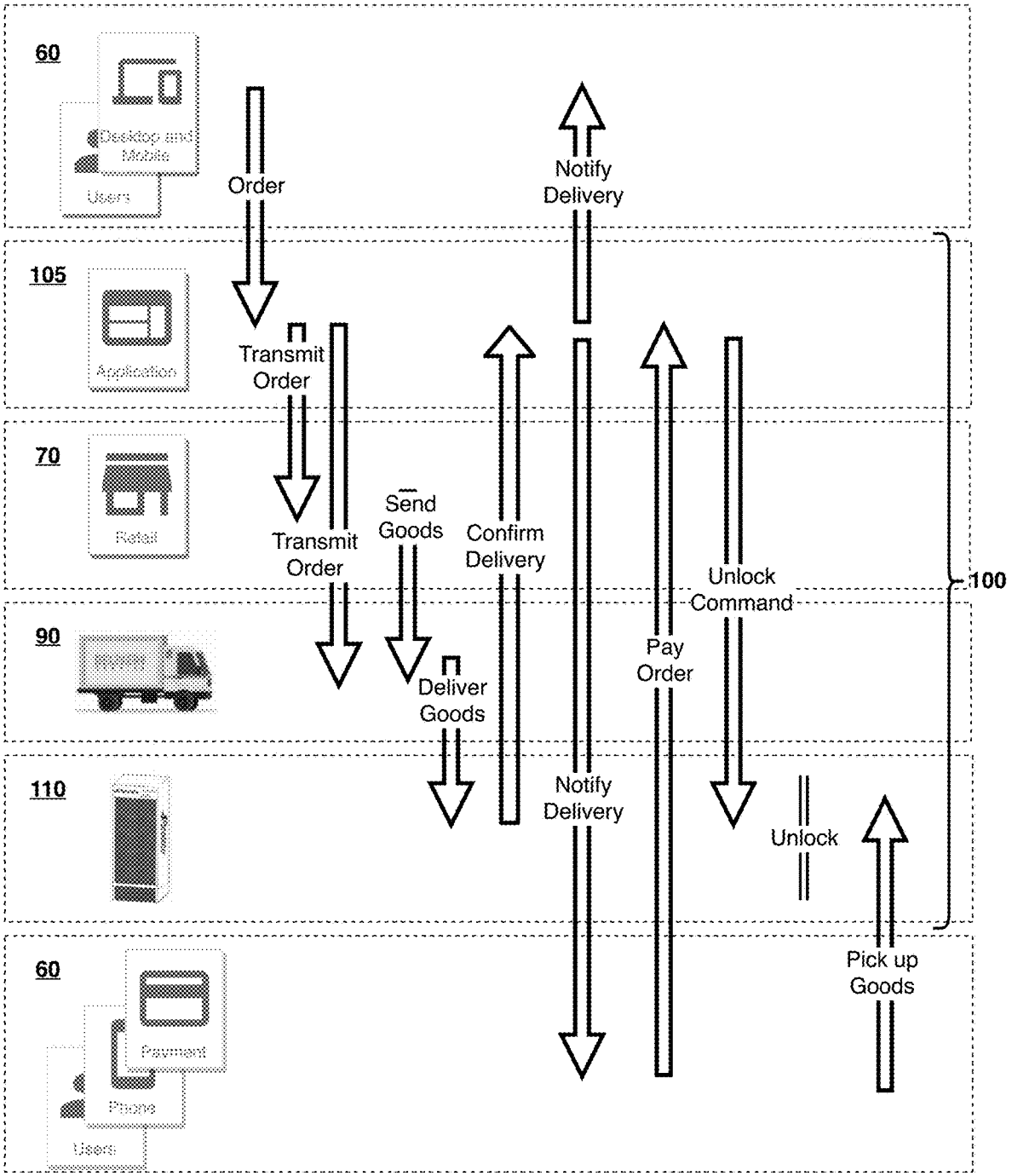
FIG. 1 is a schematic of transmission of signals and goods between participating actors of a goods ordering, delivering and pick up process.

The realizations will now be described more fully hereinafter with reference to the accompanying figures, in which realizations are illustrated. The foregoing may, however, be embodied in many different forms and should not be construed as limited to the illustrated realizations set forth herein.

With respect to the present description, references to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values and of values herein or on the drawings are not intended to be limiting, referring instead individually to any and all values falling within the range, unless otherwise indicated herein, and each separate value within such a range is incorporated into the specification as if it were individually recited herein. The words "about", "approximately", or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described realizations. The use of any and all examples, or exemplary language ("e.g.," "such as", or the like) provided herein, is intended merely to better illuminate the exemplary realizations and does not pose a limitation on the scope of the realizations. No language in the specification should be construed as indicating any unclaimed element as essential to the practice of the realizations. The use of the term "substantially" is intended to mean "for the most part" or "essentially" depending on the context. It is to be construed as indicating that some deviation from the word it qualifies is acceptable as would be appreciated by one of ordinary skill in the art to operate satisfactorily for the intended purpose.

In the following description, it is understood that terms such as "first", "second", "top", "bottom", "above", "below", and the like, are words of convenience and are not to be construed as limiting terms.

The terms "top", "up", "upper", "bottom", "lower", "down", "vertical", "horizontal", "interior" and "exterior" and the like are intended to be construed in their normal meaning in relation with normal installation of the secured delivery box.

In realizations, there are disclosed components of a secured delivery box with remote unlocking capability.

It will be noted that throughout the appended drawings, like features are identified by like reference numerals.

First, one must understand that the secured delivery box 110 is either part of a delivery system 100 or operating in association with a delivery server 105 part of a delivery system 100, wherein the delivery server 105 is adapted to receive orders from the patrons 60, communicate orders to shops 70, aka retailer 70, follow the delivery by a delivery vehicle 90 of the goods 80 from the retailers 70 to the secured delivery box 110, follow payment transactions, and communicate to the secured delivery box 110 an approval for pick-up of the goods from the secured delivery box 110.

FIG. 1 shows such process from left to right, beginning with the order being generated by a patron 60 using a computer or a mobile device in communication with the delivery server 105. Following, the delivery server 105 transmits the order to the retailer 70 and signals the delivery service 90 that the retailer 70 has goods to be delivered. Following, the goods as picked us by the delivery service 90 and delivered in the secured delivery box 110.

At the location of the secured delivery box 110, the delivery service 90 provide signals that, directly or indirectly, identifies the goods to be stored, with storage areas of the secured delivery box 110 being unlocked accordingly. It is to be noted that the selection of the storage areas is based on the status (free/occupied) of the storage areas and on the temperature of the storage areas, which must match the temperature at which the goods should be stored therein.

Upon delivery of the goods, delivery confirmation is transmitted to the delivery server 105, which is transmitted to the patron via email or notifications for examples. When the patron 60 is ready to retrieve the goods from the secured delivery box 110, the patron 60 accesses the secured delivery box 110 and performs a pick up action such as completing the payment of the goods, which, upon reception by the delivery server 105 signals, the secured delivery box 110 to unlock, aka provide access to the goods. At that point, the patron 60 is free to pick up the goods.

Not illustrated further include administrative processes such as payment validation, payment transfer between the delivery server 105 and the retailer 70, and optionally with the delivery service 90. Further processes include account identification process, preference saving and loading, management of loyalty points, etc.

Figure 2:
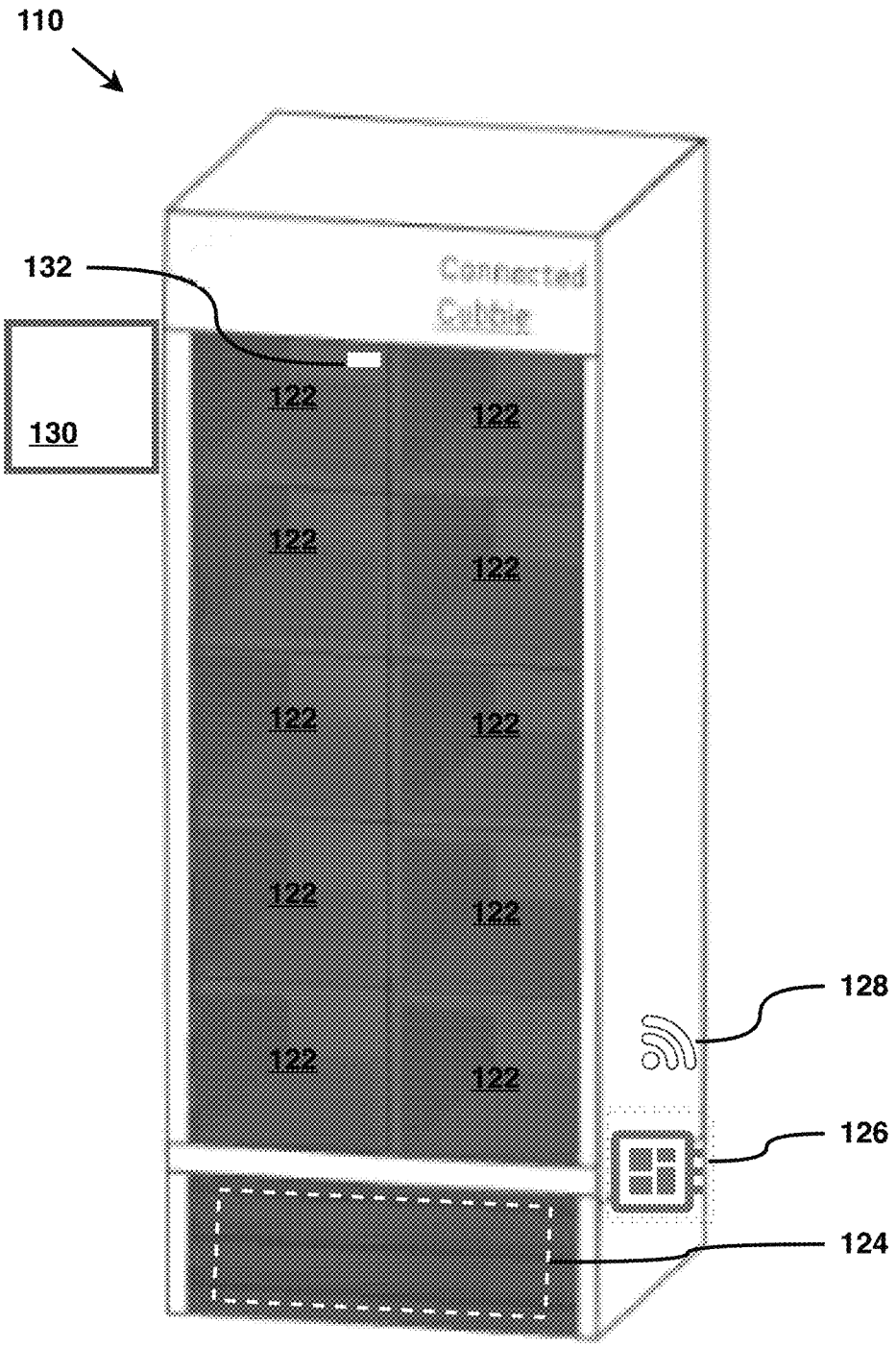
FIG. 2 is a perspective view of a secured delivery box 1.

Referring to FIG. 2, the secured delivery box 110 typically comprises a plurality of storage areas 122 each individually accessible through an unlockable door 130. The secured delivery box 110 is designed to be installed in a publicly accessible area where a plurality of patrons 60 may easily access the secured delivery box 110. Examples of publicly accessible areas comprises residential building entrances and commercial areas.

According to an embodiment, the secured delivery box 110 is designed to be portable. Accordingly, the secured delivery box 110 may be moved from one area to another upon required, or may be moved in or on a vehicle such as the delivery vehicle can come to the door of the patron 60 with the goods stored therein. Further, in some conditions, patrons 60 may be the one providing the goods to be stored temporarily in the secured delivery box 110.

The secured delivery box 110 is adapted to be connected to a power source (not shown) since the secured delivery box 110 is adapted to provide a temperature-controlled environment. In order to provide such a temperature-controlled environment, the secured delivery box 110 comprises a refrigeration system 124 (e.g. refrigerant, compressor, refrigerant circulation circuit, thermometers, etc.) with the refrigerant circuit being adjacent to at least one of the storage areas 122, thereby being able to cool down said storage area 122.

The secured delivery box 110 further comprises a processor 126 and a network connection 128 (e.g. a wire connection, a Wi-Fi connection, a cellphone internet connection, etc.) whereby the processor 126 is able to exchange signals with the delivery server 105. Thereby, one could say that the secured delivery box 110 enters in the category of the Internet of Things (IoT).

According to a first realization, the doors 130 are mounted on hinges (not shown) and movable between a first position wherein a door 130 closes an associated storage area 122 and a second position (as depicted on FIG. 2) wherein the door 130 is pivoted around its hinged away from its associated storage area 122, thereby providing free access to the storage area 122 where goods may be ready to be picked up.

The secured delivery box 110 further comprises a locking mechanism 132 associated with each one of the doors 130, wherein the locking mechanism 132 is further connected to the processor 126 which is adapted to lock and unlock the locking mechanism 132. Thereby, the processor 126 of the secured delivery box 110 is able to control the state of the locking mechanism 132 to give and prevent access according to the process depicted on FIG. 1.

According to a realization, the locking mechanism 132 comprises a spring or other abutting mechanism (not depicted) forcing the door 130 to pivot at least a little over its hinges when unlock thereby allowing to easily visually identified the unlocked door 130 from the locked doors 130.

According to a realization, closing of the door 130 is designed to be contactless, with the locking mechanism 132 being adapted to open and close the door 130. According to one option, controls are available via the smart phone of the patron 60 to command the opening and the closing of the door 130. According to another option, the door 130 opens fully with the locking mechanism 132 is unlocked, and a delay long enough is set after the opening for an automated closing of the door 130, whereby the patrons 60 are provided with the required time to pick up the goods without having to touch anything else than the goods.

According to a realization, the door mechanism (not depicted per se) comprises closing means to pivot the door 130 into a position wherein the locking mechanism 132 may lock the door 130 without human intervention in case the door 130 is left open after goods are picked up from the associated storage area 122.

According to a first method for a patron 60 to access a storage area 122 containing order goods, the patron 60 is noticed of the delivery of the goods (e.g. confirmation of location of the secured delivery box 110, identification, e.g. number, of the door 130 and thus storage area 122, etc.). The patron 60 accesses the location of the secured delivery box 110, and connect to the delivery server 105 using a mobile device such a smart phone. The patron 60 performs payment for the goods, with the delivery server 105 signaling an unlock signal to the secured delivery box 110. The signal comprises an identification of the door 130 to unlock. The processor 126 of the secured delivery box 110, upon reception of the signal, transmits a signal to the locking mechanism 132 to release the lock of the door 130 and thus provide access to the associated storage area 122. At that step, the patron 60 opens the door 130 and picks up the goods kept therein.

According to a realization, the secured delivery box 110 comprises monitoring means (not shown) designed to monitor if goods are picked up after a door 130 being unlocked. According to a first such realization, the locking mechanism 132 comprises a contact monitoring means (not depicted) whereby the opening of the door 130 is monitored and transmitted to the processor 126. According to a second and a third such realization, displacement of the goods is monitored using either a scaled floor in the storage area 122 or a movement monitoring means within the storage area 122. Regardless of the solution, signals are transmitted to the processor 126 in relation with goods being stored in the storage areas 122 and being removed from the storage areas 122.

The secured delivery box 110 provided therefore a solution for patrons 60 to be delivered sensible goods that are kept in a temperature-controlled environment and wherein picking up the goods from the secured delivery box 110 requires none to limited contacts, and therefore limiting the risks of transmission of diseases through pathogens.

According to a particular realization, the temperature of the storage areas 122 are controlled by the processor 126 is communication with components of the refrigeration system 124. Through these components, the processor 126 is able to individually set temperatures of the storage areas 122.

According to a realization, information on the goods to be delivered in the secured delivery box 110 comprises dimensions of the package, temperature or temperature range in which the package should be stored, and if the goods comprises allergenic substance, wherein the processor 126 selects one of the storage areas (e.g. among small-size storage areas, medium-size storage areas and large-size storage areas) based on the dimensions of the package, and the relative position (e.g. on the top row) of the storage area 122 to optimize temperature control and prevent the storage of goods comprising allergenic substances is some storage areas to limit risks of allergic reactions.

According to another realization, the secured delivery box 110 comprises heating components (not shown) allowing to individually heat the storage areas 122 to a desired temperature.

According to another realization, the secured delivery box 110 comprises both refrigerated storage areas 122 and heated storage areas 122, wherein a storage area 122 is selected based on the requirements transmitted by the delivery server 105 for the goods to be stored therein.

According to most of these embodiments, the secured delivery box 110 comprises a register wherein storage area data (e.g. size (small/medium/large), refrigerated (yes/no), heated (yes/no), status (free/occupied), etc. are maintained, with the processor 126 accessing and/or updating the register when at least some of receiving signals of goods to be delivered, monitoring of goods being delivered in one of the storage areas, and monitoring of goods being picked up from one of the storage areas.

The secured delivery box 110 further comprises a battery (not shown) allowing to access the storage areas 122 and maintain the temperature of the storage areas 122 in case of power shortages.

The secured delivery box 110, through communications between the processor 126 and the delivery server 105, provides a solution to keep a live log of the states of the storage areas 122, comprising the temperature monitored with the thermometers of the refrigeration system 124. Thereby, the secured delivery box 110 is monitored live with the delivery server 105 generating an alert when malfunctions occurs for a maintenance crew to respond rapidly to malfunctions that could affect the quality of the goods stored in the secured delivery box 110.

As a result, the secured delivery box 110 in communication with a delivery server 105 features a series of advantages, comprising:

- availability for patrons 60 to purchase goods using browsers and a Point of Sale (PoS) application on a personal smart phone enabling a touchless experience;
- access to an unlimited number of secured delivery boxes 110 for a same patron 60 with the same personal device;
- the secured delivery box 110 being monitored temperature controlled;
- the secured delivery box 110 comprising a battery providing extra security for access and temperature control;
- the secured delivery box 110 being waterproof and being constructed to resist to vandalism with the minimal number of components being accessible to passersby;
- the secured delivery box 110 providing solution to minimize the risks of unauthorized accesses to the storage areas 122 through unique usage access codes via personal devices, decreasing significantly the risks of unauthorized accesses compared to physical key accesses and magnetic key accesses;
- data security via encrypted data, through e.g. Advanced Encryption Standard (AES) technology, being exchanged between the secured delivery box 110 and the delivery server 105; and
- ability of remotely control the secured delivery box 110 for access and monitoring purposes.

According to one realization, the locking mechanisms 132 comprise a keypad (not shown) mounted to the exterior of the door 130, wherein the keypad provides an alternative solution to open the door 130. With this solution, the patron 60 when providing payment for the goods is provided with a code to enter through the keypad to unlock the door 130 and get access to the corresponding storage area 122.

According to one realization, the secured delivery box 110 comprises another touchless unlocking solution such as 1) an optical reader able to read a e.g. QR code displayed in front of the optical reader to recognize a patron and unlock the appropriate locking mechanism 132; and 2) a device detection solution such as Bluetooth used to identify and establish an handshake between the secured delivery box 110 and the device of the patron 60 and thereby identify the patron 60 and unlock the appropriate locking mechanism 132.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A secured delivery box for storing and providing access to goods therefrom, comprising:

- a structure defining storage areas to store the goods;
- doors, wherein each door is controllably movable between a closed position and an open position respectively preventing and providing access to a respective one of the storage areas, the doors being operative to reach the closed position automatedly following a delay after the doors reach the open position;

locking mechanisms, wherein each locking mechanism is associated to a respective one of the doors, and wherein the locking mechanisms when in a lock state lock the respective door in a closed position preventing access to the respective one of the storage areas; and a processor connected to Internet and to the locking mechanisms, wherein the processor is adapted to signal the locking mechanisms to exit the locked state.

2. The secured delivery box of claim 1, further comprising a temperature control system for maintaining temperature of one of the storage areas within a temperature range, wherein the processor is adapted to unlock the door of the temperature-controlled storage area upon reception over the Internet of a signal indicative of the goods to be stored should be stored at a temperature within the temperature range.

3. The secured delivery box of claim 1, further comprising a keypad, wherein the keypad provides an interface to enter a code to unlock the locking mechanisms.

4. The secured delivery box of claim 2, further comprising a keypad, wherein the keypad provides an interface to enter a code to unlock the locking mechanisms.

* * * * *